US005759371A

United States Patent [19]

Walker et al.

[11] Patent Number: 5,759,371

[45] Date of Patent: Jun. 2, 1998

[54] ELECTROCOAT PAINTING OVERLOAD PROTECTION CIRCUIT AND METHOD

[75] Inventors: Timothy C. Walker, Hebron; James A. Bernth; H. Frederick Hess, Jr., both of Valparaiso, all of Ind.

[73] Assignee: UFS Corporation, Valparaiso, Ind.

[21] Appl. No.: 677,209

[22] Filed: Jul. 9, 1996

[51] Int. Cl.[6] ..... C25D 13/00

[52] U.S. Cl. ..... 204/474; 204/472

[58] Field of Search ..... 204/474, 472, 204/623, 626

[56] References Cited

U.S. PATENT DOCUMENTS

| | | | |
|---|---|---|---|
| 3,658,676 | 4/1972 | De Vittorio et al. | 204/626 |
| 4,452,680 | 6/1984 | Jackson et al. | 204/474 |
| 4,851,102 | 7/1989 | Inoue | 204/623 |

*Primary Examiner*—Kathryn L. Gorgos
*Assistant Examiner*—Kishor Mayckar
*Attorney, Agent, or Firm*—Loudermilk & Associates

[57] ABSTRACT

An overload protection and control circuit and methods for electrocoat painting systems is disclosed. A resistive shunt is utilized to generate a voltage proportional to the level of current flow to electrodes in the electrocoat painting system. After amplification, the generated voltage is compared with a reference voltage. If the current exceeds a predetermined level, indicative of an overcurrent condition, a comparator causes a control circuit to disable current flow. A timer is provided to delay re-enabling of current flow for a predetermined delay interval. The control circuit may receive inputs from a control PLC or computer. The control PLC or computer may receive inputs from sensors such as a pH sensor or a membrane monitor. The control PLC or computer may selectively control the control circuit to various electrodes so as to more appropriately operate the electrocoat painting system.

12 Claims, 5 Drawing Sheets

ELECTROCOAT PAINTING OVERLOAD PROTECTION CIRCUIT AND METHOD

FIELD OF THE INVENTION

The present invention relates to electrocoat painting systems and methods, and more particularly to current sensing and overload protection and control circuits and methods that are particularly useful in electrocoat painting systems.

BACKGROUND OF THE INVENTION

Electrocoat painting often is utilized to paint objects such as car bodies, washing machines and other appliances and equipment. Electrocoat painting tends to apply paint in a more uniform manner than, for example, spraying, and thus finds application in many areas in which uniformity of the paint film is critical. An exemplary application is the painting of car bodies, an application in which corrosion of the car body may result if the paint is not properly and uniformly applied.

Electrocoat painting generally is conducted in the following manner. The workpiece being painting, or "load," is moved into a electrocoat paint bath, such as by a conveyor. The load serves as a counter-electrode to electrodes positioned in peripheral portions of the paint bath, such as the top, bottom, bottom and sides. The electrodes often are what are known as membrane electrode cells, which can serve to remove neutralizer from the paint bath as the paint is depleted and replenished in order to maintain proper acid balance in the paint bath. Electrical current flow is induced between the electrodes and the counter-electrode, with the result that a paint film is deposited on the counter-electrode. After a suitable amount of time, and after a suitable paint film has been deposited, the counter-electrode is removed from the paint bath. Reference is made to U.S. Pat. Nos. 4,711,709, 5,213,671 and 5,478,454 for more a detailed description of types of electrocoat painting electrode cells, processes and devices such as are applicable with the present invention (these patents are incorporated herein by reference).

One problem that can arise in such electrocoat painting systems and methods is an overcurrent condition, which typically indicates that an abnormal and potentially damaging or dangerous situation has arisen. An example of an environment that may result in such an overcurrent condition is illustrated in FIG. 1. Car body 12 is positioned in paint bath 20 by support member 10. Support member 10 typically is part of a conveying mechanism for car body 12 in order to move car body 12 through paint bath 20, and also serves to provide an electrical connection to car body 12 so that it may serve as the counter-electrode in the electrocoat paint process. Retainer pole 14 serves, for example, to hold the rear door of car body 12 in an open position, but in some situations may come loose and drop down as illustrated. In such circumstances, the counter-electrode (car body 12) may effectively be short circuited to floor electrodes 16, as illustrated by dotted line 18. Without the resistance offered by the paint bath, such a low resistance short can result in extremely high current. It should be understood that other situations also can arise that lead to such shorting, etc., such as side doors or trunks opening or coming loose, other parts coming loose or falling into the paint bath, etc.

In such an overcurrent situation, high current flow can damage the electrical equipment supplying power to the electrodes, such as destruction of a current-applying device or connecting shunt such as might be coupled to a bus bar, or otherwise result in undesirable operation of the manufacturing line in which the electrocoat paint system is installed. In certain situations, the electrodes coupled to the damaged device or shunt are effectively removed from the electrocoat painting process, thereby reducing the efficiency of the process (such as requiring a longer period of time for a suitable paint film to be deposited). If the equipment is damaged, the manufacturing line typically must endure a costly and disruptive shut-down in order for the damaged equipment to be replaced. Similarly, if the abnormal current situation results in a blown fuse or tripped circuit breaker, then similar manufacturing line shut-downs may occur. As many electrocoat painting systems from time-to-time encounter temporary high current conditions, undesirable line shut-downs may occur at an unacceptable level.

SUMMARY OF THE INVENTION

It is an object of the present invention to address such limitations of conventional electrocoat painting systems by providing circuits and methods in which current flow is temporarily disabled upon detection of an overcurrent condition, and after a suitable delay period the current again is enabled. If an overcurrent condition is again detected, the current flow is again disabled. This process may be repeated until the overcurrent condition abates, and thereafter the system may continue normal operation.

The present invention has as an object to provide a "variable current overload" (or "VCO") controller that may be suitably applied in an advanced and/or automated electrocoat painting system. In certain preferred embodiments, one VCO controller is supplied for each electrode (or membrane electrode cells, etc.) in the electrocoat painting system.

Additional objects, features and/or benefits are provided by various embodiments of the present invention.

In accordance with preferred embodiments of the present invention, a low impedance resistive shunt is utilized as a mechanism to measure or determine the level of current flow in the electrocoat painting system. A differential voltage is derived from the shunt and amplified by a buffer amplifier. The buffer amplifier outputs a differential voltage, which is supplied to a differential amplifier. The differential amplifier converts the differential voltage output from the buffer amplifier to a single-ended output voltage. The output voltage from the differential amplifier is applied to a comparator, to which also is applied a reference voltage, with the reference voltage selected dependent upon the desired trip point or threshold current for the overload condition (which may be selected based on the particular application and/or desired threshold current level). The output of the comparator is coupled to a timer, which is in turn coupled to a control circuit. The control circuit selectively enables or disables current flow to the electrocoat paint system electrode. In the event that current flow is disabled due to detection of an overcurrent condition, the timer provides a delay before current flow is enabled again. The timer provides an adjustable delay time and serves to prevent oscillating current surges, which could lead to damage to the device(s) supplying current to the electrocoat painting system. After the delay interval, current flow is again enabled. If the overcurrent condition persists, then the current flow/delay process repeats until the overcurrent condition no longer persists. Once the overcurrent condition abates, current flow is enabled and the electrocoat painting process continues in a normal manner until occurrence of another overcurrent condition.

Also in accordance with the present invention, a switch or switches is/are provided with the VCO controller in certain embodiments so that the system operator may selectively engage or disengage the VCO controller, thereby selectively activating or deactivating the VCO function. In yet other embodiments, an output of the VCO controller provides a measurement of current or other information to a programmable logic controller ("PLC") or other manufacturing process control or computing device. In such embodiments, individual membrane electrode cells/electrodes may be monitored and controlled, such as for "trending" or otherwise recording data such as current levels, voltage drop, membrane resistance, acid balance, etc., for the various membrane electrode cells, with such data available for the electrocoat paint system operator to use for optimization of the overall electrocoat painting process by individual control over the membrane electrode cells.

In yet other embodiments, the electrocoat painting process may include, for example, membrane electrode cells that remove a relatively large amount of neutralizer (e.g., acid or amine) and membrane electrode cells that remove a relatively low amount of neutralizer. In such embodiments, under PLC, computer or other control, the high or low neutralizer-removal membrane electrode cells may be selectively activated or deactivated in order to remove neutralizer at a rate that more effectively achieves a desirable pH level in the electrocoat paint bath.

In still other embodiments, the present invention includes computing and/or control resources in order to track various counter-electrodes through the paint bath in order to optimize the number/type of membrane electrode cells/electrodes for the surface area of the particular counter-electrodes. For example, larger counter-electrodes may be painted with a greater number of membrane electrode cells/electrodes active, while a smaller counter-electrode may have a lesser number of membrane electrode cells/electrodes active, etc. In accordance with such embodiments, a more optimum "electrode area/counter-electrode area" balance may be obtained in order to efficiently apply a suitable thickness of paint to varying size counter-electrodes such as for example, with a substantially constant rate of movement through the paint bath.

The present also provides a method of electrocoat painting with the steps of: moving a counter-electrode into a electrocoat paint bath; enabling electrical current flow between the counter-electrode and one or more electrodes in the electrocoat paint bath; measuring the level of the electrical current flow to one or more of the electrodes; disabling the electrical current flow in response to the electrical current flow reaching or exceeding a predetermined level; delaying for a predetermined period of time; and re-enabling the electrical current flow. After re-enabling electrical current flow, the process repeats until the measured level of the electrical current flow is below the predetermined level, or until an operator of the electrocoat painting system takes other action, which may include disabling the control circuit, investigating and remedying the cause of the overcurrent condition, etc.

Methods in accordance with the present invention also may include recordation of data for individual membrane electrode cells/electrodes and individual membrane electrode cells/electrodes for purposes of achieving more optimum pH levels and/or more efficient painting of varying size electrodes.

The present invention will now be described more specifically with reference to the attached drawings.

DESCRIPTION OF THE PREFERRED EMBODIMENTS

Referring now to the attached drawings, various preferred and alternative embodiments will be described for illustrative purposes.

Figure 1:
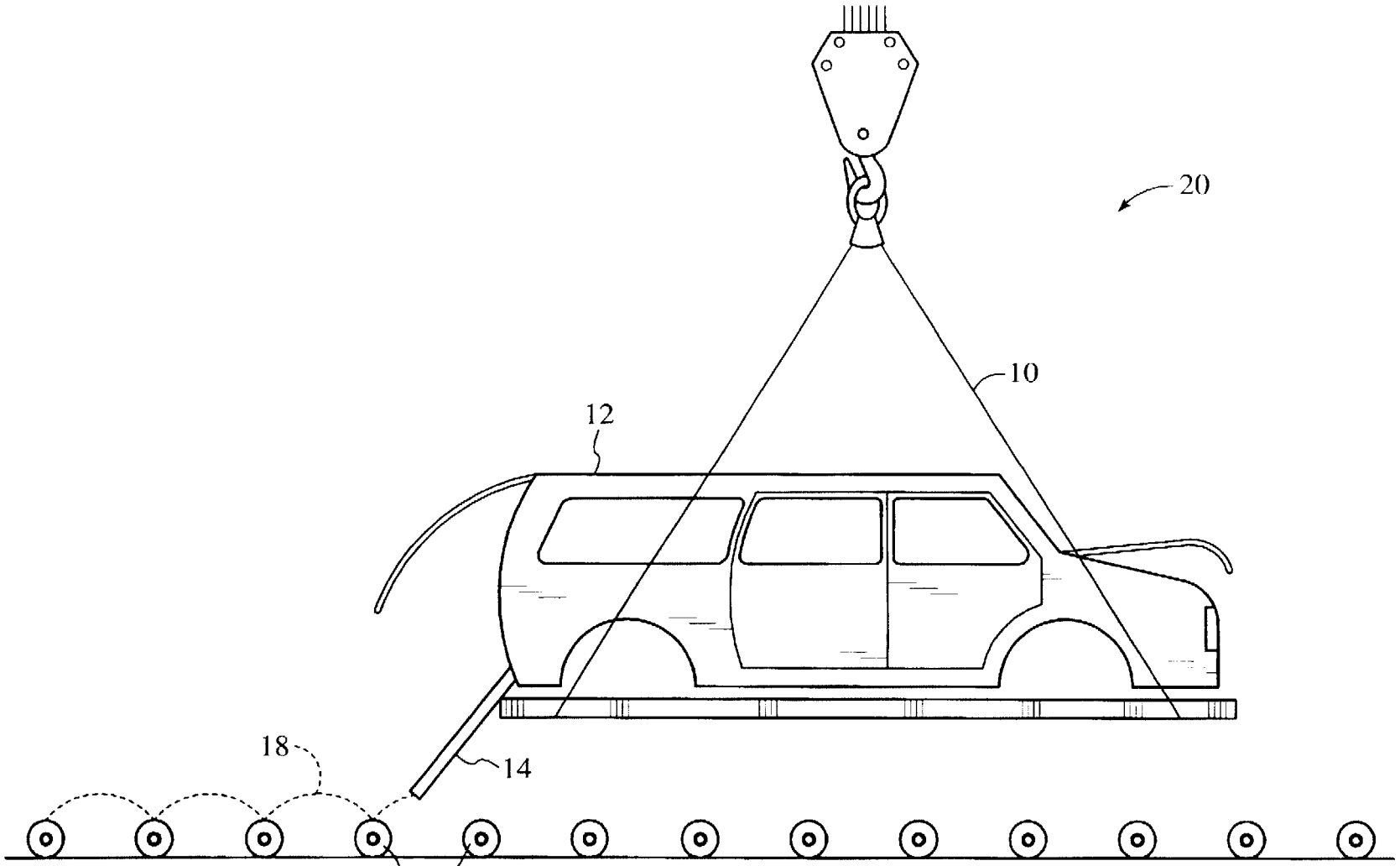
FIG. 1 illustrates an operative environment for embodiments of the present invention.

As previously described, FIG. 1 illustrates an electrocoat painting application in which an overcurrent situation may result, such as from retainer pole 14 accidentally dropping to provide a low resistance path, or short circuit, from counter-electrode/car body 12 to electrodes 16 (dotted line 18 illustrates such undesirable shorting as car body 12 moves through paint bath 20). In such operative environments, the present invention, as more fully described herein, may be desirably applied to detect the overcurrent condition, temporarily disable current flow to avoid damage, fuses being blown, circuit breakers tripping, etc., and after a suitable predetermined delay interval re-enabling current flow.

Figure 2:
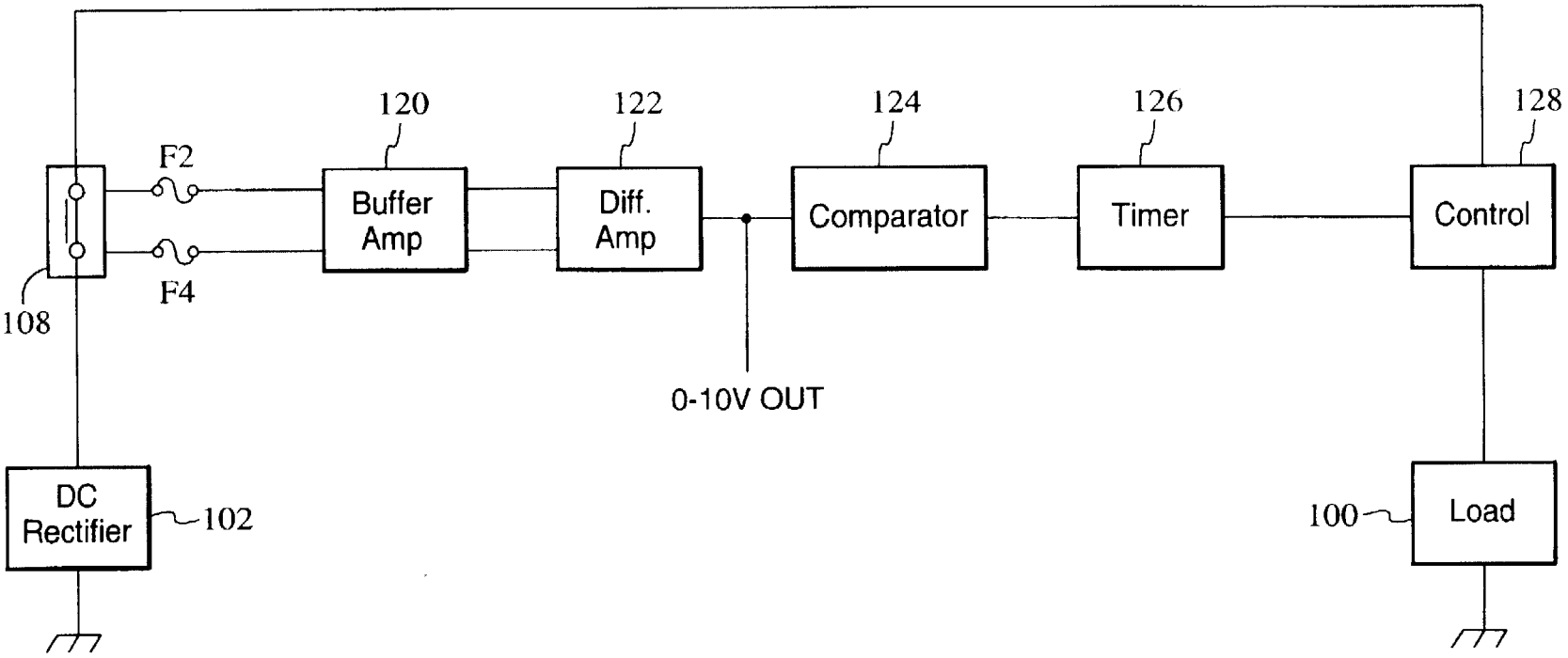
FIG. 2 is a block diagram illustrating preferred embodiments of the present invention.

FIG. 2 is a block diagram illustrating preferred embodiments of the present invention. DC rectifier 102 serves to provide a large, stable source of current for the electrode cells of the electrocoat painting system. Current from rectifier 102 flows through resistive shunt 108 to control unit 128. In most applications, multiple electrodes and shunts and other circuitry are provided, etc. (such as one VCO controller per electrode), although for illustrative purposes only a single shunt and coupled circuitry are discussed. Under control of control unit 128, the current flows through load or counter-electrode 100 to accomplish the electrocoat paint deposition process. Although not expressly shown in FIG. 2, as would understood by those skilled in the art, the current path illustrated through load/counter-electrode 100 includes the paint bath and one or more electrodes in the paint bath. Such electrodes in the paint bath may be implemented as plate, box, semicircular or other electrodes, but in preferred embodiments are membrane electrode cells such as described in U.S. Pat. Nos. 4,711,709 and 5,213,671, which have been incorporated herein by reference.

A differential voltage is provided by shunt 108 to buffer amplifier 120 through fuses F2 and F4. The differential voltage provided by shunt 108 is proportional to the current flow through the counter-electrode and electrode, and thus serves in the present invention as a means to electrically measure such current flow. Buffer amplifier 120 amplifies the differential voltage provided by shunt 108, with a gain selected to provide suitable sensitivity at a desired mid-voltage range in view of the expected current levels, resistance value of shunt 108, etc.

The differential voltage output by buffer amplifier 120 is coupled to differential amplifier 122. Differential amplifier 122 converts the differential voltage at its inputs to a single-ended output voltage. Differential amplifier 122 also may serve to balance out common mode noise that may be produced, for example, by irregularities in resistor components, etc. Differential amplifier 122 effectively isolates the output signal from high common mode voltages, and produces in preferred embodiments an output voltage from between 0 and 10 volts with reference to a common voltage of the power supply that supplies power to the various circuit components. The output of differential amplifier 122 provides an analog output voltage proportional to the current through shunt 108.

The output of differential amplifier 122 also is provided to comparator 124. Comparator 124 compares the output of differential amplifier 122 with a reference voltage level, with the reference voltage level determined by the desired current level at which current flow should be disabled (as being indicative of an overcurrent condition, etc.). The output of comparator 124 is coupled to timer 126, which is in turn coupled to control unit 128. As more fully described below, comparator 124, timer 126 and control unit 128 serve to disable the current flow if the current reaches or exceeds a predetermined/threshold current level, then waits for a predetermined interval of time (set by timer 126), and then re-enables current flow. If the overcurrent condition persists, then control unit 128 again disables current flow; if the overcurrent condition has abated, then current flow continues in the normal manner.

Figure 3A:
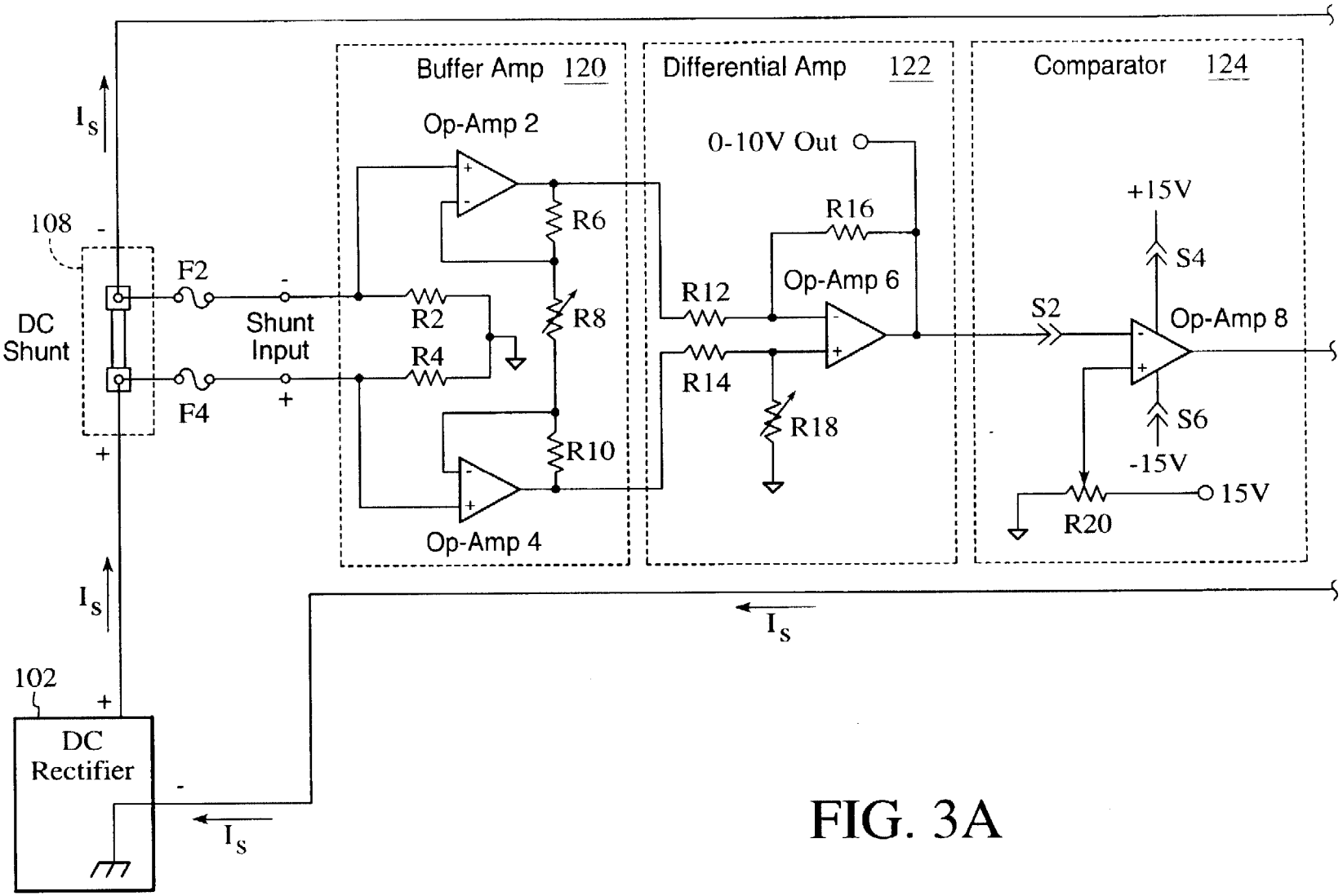
FIG. 3 is a circuit diagram illustrating preferred embodiments of the present invention.
Figure 3B:
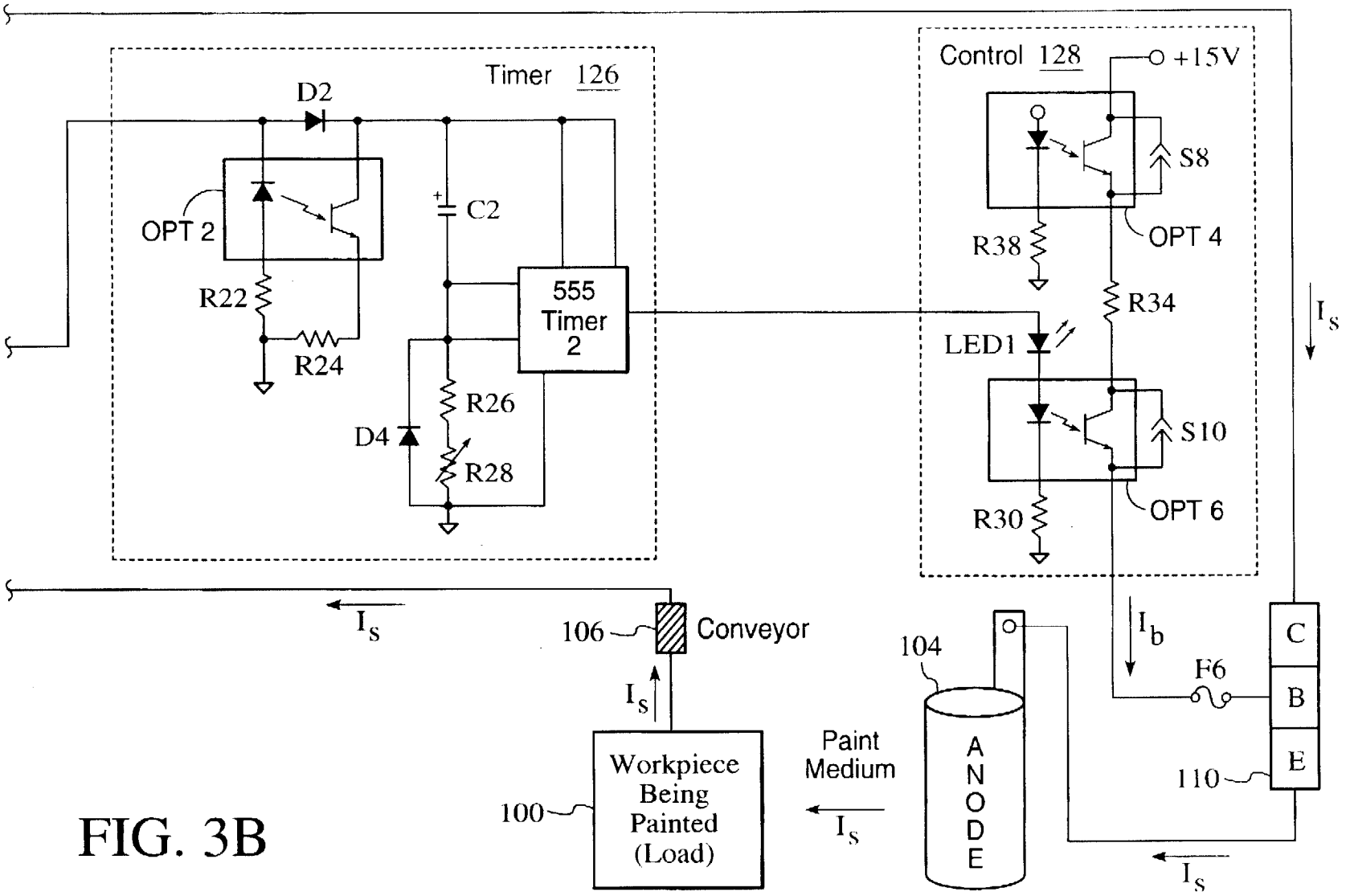

FIG. 3 is a circuit diagram illustrating in greater detail preferred embodiments of the present invention. Buffer amplifier 120 in preferred embodiments consists of two op-amps, op-amp 2 and op-amp 4, coupled as illustrated by resistors R2, R4, R6, R8 and RIO. The resistance values of the resistors are selected to provide suitable gain for buffer amplifier 120 as previously described, and in preferred embodiments resistor R8 is provided in an adjustable form (such as a potentiometer) so that the gain of buffer amplifier 128 may be desirably adjusted.

The differential output voltages from buffer amplifier 120 are applied to differential amplifier 122 by way of resistors R12 and R14, which preferably have the same resistance value. Resistor R16 is coupled between the output of op-amp 6 and the inverting input of op-amp 6. In preferred embodiments resistor R18 is provided in an adjustable form (such as a potentiometer) so that it may be adjusted in order to balance the amplifier in order to have a single-ended output substantially equal to the differential voltage level input. The output of op-amp 6 is provided as an output signal proportional to, and indicative of, the level of current flow. The output of op-amp 6 also is input to comparator 124.

In the preferred embodiment comparator 124 consists of op-amp 8, with the output of differential amplifier 122 coupled to the inverting input of op-amp 8, and a reference voltage derived from the wiper of variable resistor R20 applied to the non-inverting input of op-amp 8. In other embodiments, a resistive divider or other suitable known techniques are utilized to provide a suitable reference voltage to the non-inverting input of op-amp 8. What is important is that a suitable reference voltage be applied to op-amp 8, with the reference voltage level being selected so that the current flow is disabled at a desirable, predetermined current level threshold. In other words, the reference voltage level serves in preferred embodiments to establish this current disable threshold.

The output of comparator 124 is coupled to diode D2 and opto-isolator OPT 2, to which is coupled resistors R22 and R24 as illustrated. Diode D2 is coupled to a first end of capacitor C2 and timer 2. Timer 2 also is coupled to a second end of capacitor C2 and also to resistors R26 and R28, which are connected in parallel with diode D4 as illustrated. In the preferred embodiment, timer 2 is what is known in the art as a "555 timer" first introduced by Signetics Corporation and now available from a variety of manufacturers (the users manual and data sheets for such 555 timers are hereby incorporated by reference). The output of timer 2 (i.e., pin 3) is coupled to opto-isolator OPT 6 through LED 1. LED 1 serves in preferred embodiments as an indicator that the VCO is active and operative to apply current to the base of darlington transistor 110. The light-emitting diode portion of opto-isolator OPT 6 is coupled to reference (or ground) through resistor R30. Timer 2, capacitor C2 and resistors R26 and R28 coupled to opto-isolator OPT 6 serve to provide an adjustable, predetermined delay, operative as follows.

During normal operation, the output of timer 2 (or pin 3) is at a high level, and opto-isolator OPT 6 supplies current to the base of darlington transistor 110. In the preferred embodiment, sufficient current is supplied to the base of darlington transistor 110 to drive it into saturation. In the event of an overcurrent condition, however, the voltage output from differential amplifier 122 will exceed the reference voltage applied to the non-inverting input of op-amp 8. As a result, the output of comparator 124 goes to a low level, and opto-isolator OPT 2 is activated, thereby discharging capacitor C2 through opto-isolator OPT 2. When capacitor C2 is discharged, the output of timer 2 (i.e., pin 3) goes to a low level, which results in darlington transistor 110 turning off, which in turn disables current flow through the electrode. After disabling of the current flow, the output of comparator 124 will again resume a high level. The output of timer 2, however, remains at a low level for a period of time dependent upon the capacitance of capacitor C2 and the resistance of resistors R26 and R28. In preferred embodiments, R28 is provided in adjustable form (such as a potentiometer) so that the delay time of timer 2 may be controllably adjusted. In preferred embodiments, the delay time is adjusted to be in the range of 5 to 115 seconds, and is such that persistence of the overcurrent condition will not result in overheating or other damage due to, for example, excessive heat dissipation due to oscillating turn-on and turn-off of the current.

While preferred embodiments utilize what is known as a "555 timer," in other embodiments other timing circuits or devices may be utilized (such as suitable digital logic coupled with delaying elements such as resistors and capacitors, etc.). What is important is that current flow may be controllably disabled after an overcurrent condition, and after a suitable delay interval re-enabled, etc.

In preferred embodiments opto-isolator OPT 6 is series connected with resistor R34 and opto-isolator OPT 4. The light-emitting diode portion of opto-isolator OPT 4 is coupled to reference (or ground) through resistor R32. Opto-isolator OPT 4 is controlled by a signal from a PLC, computer or other control device (see, e.g., FIG. 4). Opto-isolator OPT 4 may serve to disable current flow irrespective of the output of timer 2 or whether an overcurrent condition exists, etc. Additionally, switches S8 and S10 are provided in parallel with opto-isolators OPT 4 and OPT 6, respectively, and may manually, or under control of a PLC, computer or other control device, provide current to the base of darlington transistor 110 in a continual manner, irrespective of the output of timer 2 or whether an overcurrent condition exists, etc. With such additional implements, for example, the electrocoat painting system may controllably turn on or off individual electrodes in the electrocoat painting system.

The emitter of darlington transistor 110 is coupled to electrode 104, which in preferred embodiments is a membrane electrode cell. Current flow through electrode 104 flows through the paint bath resulting in paint film deposition on load or counter-electrode 100, which is electrically coupled to DC rectifier 102 such as through conveyor 106.

Figure 4:
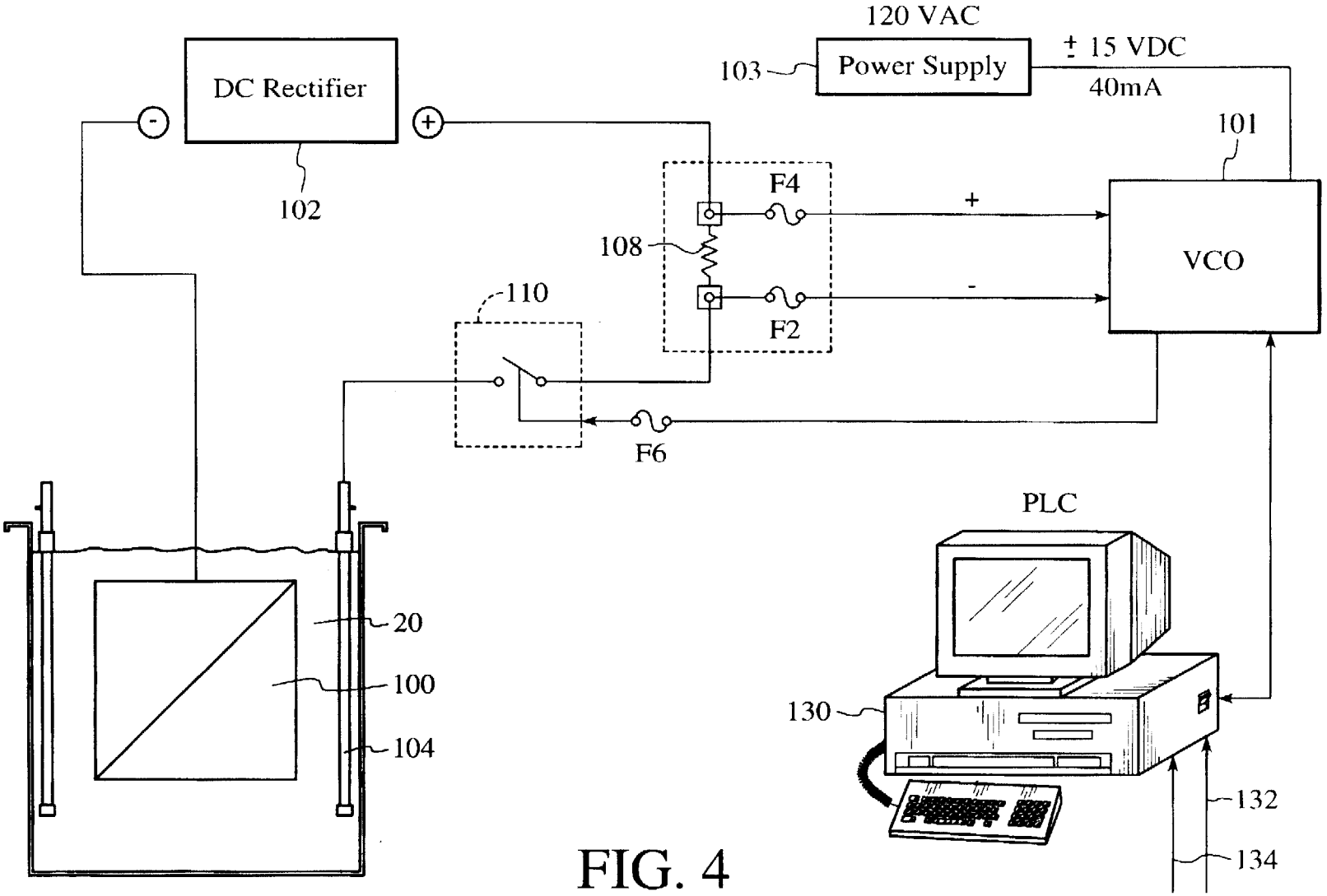
FIG. 4 is a block diagram illustrating other aspects of preferred embodiments of the present invention.

FIG. 4 is a block diagram illustrating other aspects of preferred embodiments of the present invention. FIG. 4 illustrates counter-electrode 100 in paint bath 20. Counter-electrode 104 is electrically coupled to one terminal of DC rectifier 102. The other terminal of DC rectifier 102 is electrically coupled to shunt 108, which is in turn coupled to one end (e.g., collector) of darlington transistor 110 (darlington transistor 110 is illustrated in FIG. 4 as a switch to illustrate that, in alternative embodiments, switching devices other than darlington transistors are utilized to controllably enable and disable current flow to electrode 104). Another end of (e.g., emitter) darlington transistor 110 is coupled to electrode 104. The control terminal (e.g., base) of darlington transistor 110 is coupled to VCO 101 through fuse F6. VCO 101 in preferred embodiments consists of buffer amp 120, differential amplifier 122, comparator 124, timer 126 and control unit 128 as previously described in connection with FIGS. 2 and 3, etc. A differential voltage is provided by shunt 108 through fuses F2 and F4 as previously described. Power is supplied to VCO 101 by power supply 103.

VCO 101 is coupled in preferred embodiments to PLC 130. Although a PLC is illustrated in FIG. 4, it should be understood that in alternative embodiments a control computer or other control device may be utilized to controllably activate and deactivate VCO 101. PLC 130 may receive a variety of inputs relating to the operation or status of the electrocoat painting system. In preferred embodiments, PLC 130 receives input 132 from a pH sensor in paint bath 20 and receives input 134 from a membrane monitor for electrodes 104 (if electrodes 104 constitute membrane electrode cells, for example). Such a membrane monitor input may be generated as described in U.S. Pat. No. 5,478,454, which has previously been incorporated herein by reference. With such inputs, PLC 130 may take appropriate control actions, or record "trend" or historical operational data, etc. In addition, as discussed previously in connection with FIG. 3, PLC 130 may controllably enable or disable current flow, irrespective of whether an overcurrent condition is detected by VCO 101, etc.

PLC 130 enables individual membrane electrode cells/electrodes to be monitored and controlled. In addition to recording data such as current levels, voltage drop, membrane resistance, acid balance, etc., for the various membrane electrode cells, PLC 130 may be used for purposes of optimization of the overall electrocoat painting process by individual control over the membrane electrode cells. As an illustrative example, membrane electrode cells may be provided that remove a relatively large amount of neutralizer (e.g., acid or amine) as well as membrane electrode cells that remove a relatively low amount of neutralizer. In such embodiments, under PLC 130, computer or other control, which may monitor the pH level of paint bath 20 through input 132, the high or low neutralizer-removal membrane electrode cells may be selectively activated or deactivated in order to remove neutralizer at a rate that more effectively achieves a desirable pH level in the electrocoat paint bath.

Additionally, PLC 130 may receive as an input data reflective of the particular counter-electrode in paint bath 20, such as surface area and/or desired paint film thickness, etc. In such embodiments, PLC 130 may track various particular counter-electrodes 100 through paint bath 20 in order to optimize the number/type of membrane electrode cells/electrodes 104 that are active for the surface area of the particular counter-electrodes or desired paint film thickness. For example, larger counter-electrodes may be painted with a greater number of membrane electrode cells/electrodes active, while a smaller counter-electrode may have a lesser number of membrane electrode cells/electrodes active, etc. In such embodiments, PLC 130 may selectively activate or de-activate individual electrodes so that a more optimum "electrode area/counter-electrode area" balance may be obtained in order to more efficiently apply a suitable thickness of paint to varying size counter-electrodes such as for example, with a substantially constant rate of movement through the paint bath. In such embodiments, additional electrodes may be activated for a larger counter-electrode or thicker paint film thickness so that the desired paint film may be applied without slowing the movement of the counter-electrode in the paint bath.

The following should also be noted. The present invention may be applied to both "anodic" systems, in which the car body or other load serves as the anode, and "cathodic" systems, in which the car body or other load serves as the cathode. Additionally, particular amplifier, comparator and timer circuits are utilized in preferred embodiments as described above, but in other embodiments other types of circuits providing suitable amplification and timed/delayed enabling/disabling of current flow are utilized. Also, the present current control system has been described for particular application in the field of electrocoat painting to which it has been advantageously applied; in other embodiments, however, the present invention may be utilized to provided conditioned current flow to other industrial equipment, such as data acquisition or process control equipment.

Although various preferred embodiments of the present invention have been disclosed for illustrative purposes, those skilled in the art will appreciate that various modifications, additions and/or substitutions are possible without departing from the scope and spirit of the present invention as disclosed in the claim. It also is to be noted that the circuit equations and expressions are provided for explanation purposes, and such discussion is not to bound to any particular circuit theory or description. In lieu of a DC shunt to measure the current, any other means to generate a proportional voltage signal, such as a toroid coil can be used.

What is claimed is:

1. An electrocoat painting method, comprising the steps of:

moving a counter electrode into an electrocoat paint bath;

enabling electrical current flow between the counter-electrode and one or more electrodes in the electrocoat paint bath to perform an electrocoat painting;

measuring the level of the electrical current flow through the counter-electrode and one or more of the electrodes in the electrocoat paint bath;

disabling the electrical current flow upon detection of a temporarily overcurrent condition in which the electrical current flow exceeds a disable current level wherein the temporarily overcurrent condition does not result in overheating, blown fuse or tripped circuit breaker;

delaying the electrocoat painting after the overcurrent condition for a delay period; and subsequently re-enabling the electrical current flow to continue the electrocoat painting.

2. The method of claim 1, wherein after the step of re-enabling the electrical current flow the steps of measuring, disabling, delaying and re-enabling repeat until the measured level of the electrical current flow is below the disable current level.

3. The method of claim 1, further comprising the steps of:

sensing a pH level of the paint bath;

selectively enabling and disabling the electrical current flow to first membrane electrodes having a first level of neutralizer removal from the paint bath and second membrane electrodes having a second level of neutralizer removal from the paint bath, wherein the second level is greater than the first level, wherein the first and second membrane electrodes are selectively enabled dependent upon the sensed pH level of the paint bath.

4. The method of claim 1, further comprising the steps of:

receiving control information with a computing device;

selectively disabling and re-enabling the electrical current flow to one or more of the electrodes in the electrocoat paint bath in response to the control information.

5. The method of claim 4, wherein the control information comprises information determined by the size of the counter-electrode.

6. The method of claim 4, wherein the control information comprises information determined by a desired paint film thickness on the counter-electrode.

7. The method of claim 4, wherein the control information comprises information selected from the group consisting of information determined by a pH level of the electrocoat paint bath, and information determined by a membrane resistance of one or more of the electrodes.

8. The method of claim 3, wherein the electrical current is disabled and re-enabled by a control circuit, wherein the control circuit generates a voltage dependent upon the level of current flow to one or more of the electrodes, wherein the generated voltage is responsive to the level of the electrical current flow.

9. The method of claim 8, wherein the generated voltage comprises a differential voltage, wherein the differential voltage is compared with a reference voltage to generate control signal, wherein the electrical current flow to one or more of the electrodes is disabled and re-enabled depending upon the comparison of the differential voltage with the reference voltage.

10. The method of claim 9, wherein the control circuit comprises a transistor and the control signal determined by the comparison is coupled to the transistor with an opto-coupling device.

11. The method of claim 8, wherein a control circuit is provided for each of the one or more electrodes.

12. The method of claim 1, wherein the counter-electrode serves as a cathode or anode in the electrocoat painting.

* * * * *

UNITED STATES PATENT AND TRADEMARK OFFICE

CERTIFICATE OF CORRECTION

PATENT NO. : 5,759,371

DATED : June 2, 1998

INVENTOR(S) : Timothy C. Walker; James A. Bernth; H. Frederick Hess, Jr.

It is certified that error appears in the above-identified patent and that said Letters Patent is hereby corrected as shown below:

Column 10, line 1, delete "claim 3" and insert --claim 1--.

Signed and Sealed this

Eleventh Day of August 1998

Bruce Lehman

*Attest:*

BRUCE LEHMAN

*Attesting Officer*

*Commissioner of Patents and Trademarks*